US006663764B2

(12) United States Patent
Thurmüller et al.

(10) Patent No.: US 6,663,764 B2
(45) Date of Patent: Dec. 16, 2003

(54) PROCESS FOR THE PREPARATION OF GLYCINE DERIVATIVES AND USE THEREOF

(75) Inventors: Oliver Thurmüller, Düsseldorf (DE); Phillipp Tomuschat, Essen (DE)

(73) Assignee: Goldschmidt AG, Essen (DE)

( * ) Notice: Subject to any disclaimer, the term of this patent is extended or adjusted under 35 U.S.C. 154(b) by 22 days.

(21) Appl. No.: 10/116,599

(22) Filed: Apr. 4, 2002

(65) Prior Publication Data

US 2002/0157943 A1 Oct. 31, 2002

(30) Foreign Application Priority Data

Apr. 6, 2001 (DE) ..... 101 17 222

(51) Int. Cl.[7] ..... C25B 3/00
(52) U.S. Cl. ..... 205/435; 205/431
(58) Field of Search ..... 564/281, 291, 564/292; 554/52, 68, 69, 103, 106; 510/123, 124, 130; 205/431, 435

(56) References Cited

U.S. PATENT DOCUMENTS 5,179,218 A 1/1993 Fried ..... 554/134
5,470,992 A * 11/1995 Gruning et al. ..... 554/69
5,792,737 A * 8/1998 Gruning et al. ..... 510/126
5,856,470 A 1/1999 Moeller et al. ..... 536/124

FOREIGN PATENT DOCUMENTS

| | | |
|---|---|---|
| DE | 29 26 479 B1 | 11/1980 |
| DE | 34 43 303 A1 | 6/1986 |
| DE | 39 29 063 A1 | 3/1991 |
| DE | 39 39 264 A1 | 5/1991 |
| EP | 0 098 802 A2 | 6/1983 |
| EP | 0 199 413 A2 | 10/1986 |
| EP | 0 269 940 A2 | 6/1988 |
| EP | 0 557 835 B1 | 5/1996 |
| JP | A-759981984 | 4/1984 |

OTHER PUBLICATIONS

Schafer, H.J., *Topics in Current Chemistry*, vol. 142, pp. 102–129 (1987) No Month.
Kaulen, J. et al., *Tetrahedron*, vol. 38, No. 22, pp. 3299–3308 (1982) No Month.

* cited by examiner

*Primary Examiner*—Edna Wong
(74) *Attorney, Agent, or Firm*—Scully, Scott, Murphy & Presser

(57) ABSTRACT

Process for the preparation of glycine derivatives, which comprises electrochemically oxidizing β-hydroxyethylammonium compounds to give the corresponding acids.

10 Claims, No Drawings

PROCESS FOR THE PREPARATION OF GLYCINE DERIVATIVES AND USE THEREOF

FIELD OF THE INVENTION

The present invention relates to glycine derivatives, and more particularly to a process for preparing glycine derivatives that are free from organically bonded halogen and/or halide ions. The present invention also relates to the use of such glycine derivatives in cosmetic preparations.

BACKGROUND OF THE INVENTION

Glycine derivatives such as betaines are known as mild and compatible substances which may be typically co-used in large amounts for the preparation of cosmetic preparations for the cleansing and care of skin and hair.

In the prior art, glycine derivatives are typically prepared by reacting tertiary amines with excess monochloroacetic acid in a basic aqueous solution at an elevated temperature.

Great efforts have, in the past, been made to prepare glycine derivatives which are free from impurities which may cause skin irritations or are otherwise undesired for toxicological and physiological reasons.

These include, in particular, residual amounts of compounds containing organically bonded chlorine, that arise as a consequence of the process, such as monochloroacetic acid (MCA) and, in particular, dichloroacetic acid (DCA) or salts thereof which are introduced into the end-product with the chloroacetic acid used.

Attempts to reduce the content of these compounds by prolonged reaction times or increasing the pH have not led to a significant reduction in impurity formation. The use of a pH above about 10, particularly at elevated temperatures around or above 100° C., brings with it the risk of increasing decomposition (DE-B-29 26 479, EP-B-0 557 835). DE-A-39 39 264 relates to a process for lowering the residual content of free alkylating agent in aqueous solutions of amphoteric or zwitterionic surfactants with the characterizing feature that the solutions are post-treated with ammonia, an amino acid having 2 to 8 carbon atoms or an oligopeptide. This post-treatment also causes a residual content of MCA and/or DCA to remain in the reaction product. In addition, however, as a result of the reaction products of ammonia and the alkylating agent or peptide and the alkylating agent, reaction products are produced which remain as impurities in the process product.

Furthermore, the reaction mixtures comprise large amounts of chloride ions in the form of their alkali metal or ammonium salts. For this reason, these prior art reaction mixtures have further disadvantages associated therewith, such as increasing the viscosity of the end-product, and impairing the low-temperature stability of formulations. Moreover, the prior art reaction mixtures cannot be formulated with a number of further active ingredients.

In addition, because of the content of chloride ions, prior art reaction mixtures are too aggressive for cleaning corrosion-sensitive metallic substrates which are used, in particular, in the electronics industry.

There has therefore been a number of attempts to remove these salts, such as, for example, by solvent extraction, as described in JP-A-759981984, or by electrodialysis according to EP-A-0 269 940. Apart from the fact that complete removal of chloride ions cannot be achieved, these prior art processes are complicated and economically disadvantageous due to the additional stages required.

There are also numerous processes which allow the oxidation of alcohols to carboxylic acids. In addition to the classical processes of oxidation on a laboratory scale by means of heavy metal oxides. (e.g. $KMnO_4$), processes are known which can be carried out on an industrial scale, such as the oxidation by $NO_2$ (U.S. Pat. No. 5,856,470), by nitrile oxides (U.S. Pat. No. 5,179,218), by $O_2$ with noble metal catalysis (DE-39 29 063) or electrochemically (EP-A-0 199 413, DE-A-34 43 303).

From works by H. J. Schäfer (Overview: Topics in Current Chemistry, 1987, 142, 102 to 129), it is known that primary alcohols can be oxidized by electrolysis in alkaline solution using anodes coated with nickel oxide hydroxide NiO(OH) and steel cathodes to give the corresponding carboxylic acids with theoretical yields between 46 and 99%. The oxidization takes place primarily by an indirect anode process in which the alcohol is oxidized by the nickel oxide hydroxide with trivalent nickel to give the carboxylic acid, the NiO(OH) being reduced to nickel oxide or nickel hydroxide with divalent nickel. As a result of electron removal at the anode, the divalent nickel then converts back into trivalent nickel.

The electrochemical oxidation of alcohols that are bonded to a quaternary positively charged nitrogen via an ethylene group is not reported in the work by H. J. Schäfer.

SUMMARY OF THE INVENTION

In the endeavor to overcome the disadvantages of the prior art and to provide a process which permits the preparation of glycine derivatives that are free from organically bonded halogen and/or halide ions, it has now been found that this objective can be achieved by the oxidation of quaternary aminoalcohols. Surprisingly, the quaternary, positively charged nitrogen does not interfere in the oxidation process, and neither oxidation products of nitrogen, such as N-oxides, nor Hoffmann degradation products can be detected. Glycine derivatives which are prepared by the inventive method are free from inorganic chlorine or organically bonded chlorine, such as, in particular, monochloroacetic acid, dichloroacetic acid and salts thereof.

The oxidation of the quaternary aminoalcohol to the corresponding glycine derivative can be carried out in the present invention by electrochemical oxidation in aqueous alkaline solution using coated nickel electrodes.

The present invention thus provides a process for the preparation of glycine derivatives by oxidation of β-hydroxyethylammonium compounds by electrolysis of an aqueous alkaline solution, which comprises carrying out the oxidation using anodes coated with nickel oxide hydroxide.

The inventive process is notable for its extraordinary environmental friendliness since no environmentally detrimental byproducts form and, the use of highly toxic chloroacetic acid can be avoided. In addition, a product free from inorganic chlorine is obtained directly, therefore avoiding the technically complex separation of chloride ions.

DETAILED DESCRIPTION OF THE INVENTION

As stated above, the present invention provides a process for preparing glycine derivatives by electrochemically oxidizing hydroxyl groups of β-hydroxyethylammonium compounds present in an aqueous alkaline solution, i.e., an electrolyte, to give the corresponding acids.

By using the electrochemical process of the present invention, the theoretical yields obtained are, without exception, greater than 80%. The electrolysis of the present invention is in principle carried out in such a way that the aqueous electrolyte is electrolyzed at electrodes that are coated with nickel oxide hydroxide. The coating of the electrodes can be carried out by customary processes, such as, for example, according to the process proposed by H. J. Schäfer. In principle, an $Ni(OH)_2$ layer is cathodically deposited from an Ni salt solution on the later anode and then anodically converted, in an alkaline solution, into NiO(OH) (J. Kaulen, H. J. Schäfer, *Tetrahedron,* 1982, 38, 3299).

Besides nickel metal, the anode materials to be coated with NiO(OH) include any material in which an activated nickel oxide hydroxide layer can adhere to, such as, for example, Monel, rust-free steel, graphite or a glassy carbon.

The cathode employed in the present invention can consist of any material customarily used in electrochemistry for the preparation of cathodes, such as, for example, noble metals, stainless steel or nickel.

The electrolysis cell employed in the present invention can consist of any material resistant to electrolyte and reactants, such as alkali-resistant glass, porcelain, polyethylene, rubber or stainless steel.

The cell type employed in the present invention may be divided or undivided, the latter being preferred since a reduction of the desired electrolysis product does not have to be feared.

The process according to the present invention can be carried out continuously or discontinuously, with preference being given to the discontinuous procedure. In this procedure, the electrolysis system consists of an aqueous solution of the β-hydroxyethylammonium compound with a pH of preferably more than 12. The alkalinity of the solutions is usually effected by alkali metal hydroxides (preferably NaOH and KOH). The alkali hydroxide necessary for neutralizing the resulting acid is added gradually, slightly less than the theoretically required amount being added so that the pH of the solution obtained when electrolysis has finished is about 9.

Advantageous contents of β-hydroxyethylammonium compound present in the alkaline solution are between 1 and 30% by weight, preferably between 20 and 30% by weight.

The electrolysis temperature employed in the present invention is normally 20 to 80° C., preferably about 70° C.

It is also advantageous in the present invention to carry out the electrolysis with a quantity of electricity higher than the theoretically required amount, preferably 1.5 to 3 times the amount of electricity.

When the electrolysis is complete, the electrolyzed solution is brought to a pH of about 6 to 7, for example with phosphoric acid, and concentrated by evaporation. Additionally, the residue may optionally be extracted from the electrolyzed solution with a suitable solvent. Alcohols (ethanol, isopropanol), for example, are suitable for this purpose. The resulting extract is freed from the solvent and produces pure betaines.

Extraction is only necessary if the intention is to obtain the salt-free betaines. However, the salts which arise in the synthesis are not usually problematic, meaning that extraction can be dispensed with.

The β-hydroxyethylammonium compounds co-used according to the present invention can be prepared by the processes known in this field by reacting amines with ethylene oxide in acidic solution (EP-A-0 098 802).

β-Hydroxyethylammonium compounds which can be used in the present invention include all compounds which contain at least one quaternary amino group and at least one OH group, preferably of the formulae (I) and/or (II) and/or (III)

(I)

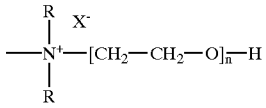

(II)

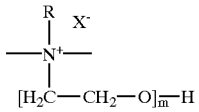

(III)

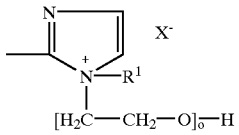

wherein each R independently of one another may be alkyl radicals having 1 to 3 carbon atoms and/or —$CH_2$—$CH_2$—OH;

n, m, o may be values between 1 and 5, preferably 1 and 3, in particular 1; and $R^1$ is an alkyl radical, optionally containing heteroatoms, in particular oxygen and/or nitrogen atoms, or the radical $R^a$—[C(O)—NH—$(CH_2)_q]_r$— where q=1 to 6, preferably 2 or 3, and r=0 or 1.

According to the present invention, preference is given to compounds in which the free valences of the general formula (I) are bonded to the radical $R^a$—C(O)—NH—$(CH_2)_3$, where $R^a$ may be an optionally substituted alkyl or alkenyl radical having 7 to 21 carbon atoms, or an optionally substituted alkyl or alkenyl radical having 1 to 22 carbon atoms, preferably having 7 to 17 carbon atoms, and the radicals R, independently of one another, may be alkyl radicals having 1 to 3 carbon atoms; or, if r=0, $R^a$ may be an alkyl or alkenyl radical having 8 to 22 carbon atoms; valences of the general formulae (I) to (III) are bonded to an optionally substituted alkyl or alkenyl radical having 1 to 22 carbon atoms, preferably having 8 to 18 carbon atoms or to the radical $R^a$—C(O)—[NH—$(CH_2)_z]_y$— in which $R^a$ has the meaning given above, and z, y, independently of one another, may be numbers from 1 to 3.

The radical $R^a$ is preferably derived from natural fatty acids, such as, for example, caprylic acid, capric acid, 2-ethylhexanoic acid, lauric acid, myristic acid, palmitic acid, palmitoleic acid, isostearic acid, stearic acid, hydroxystearic acid (ricinoleic acid), dihydroxystearic acid, oleic acid, linoleic acid, petroselic acid, elaidic acid, arachidic acid, behenic acid, erucic acid, and gadoleic acid, as well as technical-grade mixtures which form during the pressurized cleavage of natural fats and oils, such as oleic acid, linoleic acid, linolenic acid and, in particular, rapeseed oil fatty acid, soybean oil fatty acid, sunflower oil fatty acid, tall oil fatty acid. All fatty acids with a similar chain distribution are suitable and thus can be employed in the present invention.

The content of unsaturated fractions in these fatty acids or fatty acid esters is, where necessary, adjusted by the known catalytic hydrogenation processes to a desired iodine number or achieved by mixing completely hydrogenated fatty components with nonhydrogenated fatty components.

The iodine number, which is a measure of the average degree of saturation of a fatty acid, is the amount of iodine taken up by 100 g of the compound to saturate the double bonds.

Preference is given to using partially hydrogenated $C_{8/18}$-coconut and palm fatty acids, rapeseed oil fatty acid, sunflower oil fatty acids, soybean oil fatty acids and tall oil fatty acids, with iodine numbers in the range from about 80 to 150 and, in particular, technical-grade $C_{8/18}$-coconut fatty acids, in which case a choice of cis/trans isomers, such as elaidic acid-rich $C_{16/18}$-fatty acid cuts may be advantageous in some instances. The aforementioned compounds are commercially available products and are supplied by various companies under their respective trade names.

The compounds of the general formulae (I) to (III) that are employed in the present invention are electrochemically oxidized to give the corresponding acids as described below.

The following examples are given to illustrate the inventive process as well as some advantages that can be obtained from using the same.

EXAMPLE 1

150 ml of a 27% strength solution of 2-hydroxyethyl (dimethyl)-3-undecylcarboxamidopropylammonium×0.5 $H_2PO_4^-$, which contained 4.2 g of NaOH, were electrolyzed for 7 h at a current strength of 2.0 A in a 150 ml beaker glass cell with reflux condenser at a mesh electrode (60.5 $cm^2$, nickel mesh coated with NiO(OH)) and a cathode (cylinder, inside diameter, Ø 1.7 cm, 7 cm high, stainless steel). During this electrolysis, the pH increased to 8 to 9 within 5 h, and 4 ml of saturated NaOH solution was added. The current strength was then adjusted to 1.0 A, and electrolysis was carried out for an additional 7 h. After this time, the solution again had a pH of from 8 to 9, and 4 ml of saturated NaOH solution was again added. A current strength of 0.5 A was then set, and electrolysis was carried out for an additional 7.5 h. The resulting solution had a pH of 8 to 9. Reaction monitoring was carried out by means of TL chromatography and ESI mass spectrometry.

The electrolysis product was adjusted to a pH of from 6 to 7 with phosphoric acid and concentrated by evaporation. The residue was extracted with isopropanol and the resulting extract was freed from the solvent. A yellow-brown solid was obtained as product.

Analysis

Yield: 23.3 g (91% of theory)

$^{13}$C-NMR (100 MHz, $CDCl_3$): δ=13.67 ($CH_3$), 22.24 to 31.48 ($CH_2$), 35.86 and 35.87 ($\underline{C}H_2CONH$ and $CONH\underline{C}H_2$), 50.32 ($N^+(CH_3)_2$), 62.12 ($CH_2N^+$), 63.98 ($N^+\underline{C}H_2COO^-$) 167.09 ($COO^-$), 174.06 (CONH) ppm.

EXAMPLE 2

The experiment was carried out analogously to Example 1. In contrast to Example 1, 2-hydroxyethyl(dimethyl)-3-undecylcarboxamidopropylammonium×0.5 $C_2O_4H^-$ was used as starting material. During the oxidation, oxalate was oxidized to $CO_2$, which reacts under the alkaline conditions to give carbonate and only then is the ammonium alcohol oxidized to the corresponding glycine derivative. The correspondingly greater amount of NaOH required was added to the solution at the start.

Analysis

Yield: 20.28 g (82% of theory)

$^{13}$C-NMR (100 MHz, $CDCl_3$): δ=13.39 ($CH_3$), 21.95 to 31.18 ($CH_2$), 35.55 (br, $\underline{C}H_2CONH$ and $CONH\underline{C}H_2$), 50.15 ($N^+(CH_3)_2$), 61.77 ($CH_2N^+$), 63.73 ($N^+\underline{C}H_2COO^-$), 165.81 ($COO^-$), 173.65 (CONH) ppm.

EXAMPLE 3

The experiment was carried out analogously to Example 1. In contrast to Example 1, 105 ml of a 2.7% strength solution of an ammonium mixture (based on the coconut fatty acid cut), which comprised as main component 2-hydroxyethyl(dimethyl)-3-undecylcarboxamidopropylammonium×0.5 $H_2PO_4^-$, were electrolyzed for 3 h at 2.0 A.

Analysis

Yield: 2.35 g (96% of theory)

$^{13}$C-NMR (100 MHz, $CDCl_3$): δ=13.69 ($CH_3$), 22.24 to 31.48 ($CH_2$), 35.84 and 35.87 ($\underline{C}H_2CONH$ and $CONH\underline{C}H_2$), 50.41 ($N^+(CH_3)_2$), 62.23 ($CH_2N^+$), 64.31 ($N^+\underline{C}H_2COO^-$), 166.14 ($COO^-$), 173.93 (CONH) ppm.

MS (ESI): m/e=365 ($M^+$+Na, 100%).

While the present invention has been particularly shown and described with respect to preferred embodiments thereof, it will be understood by those skilled in the art that the foregoing and other changes in forms and details may be made without departing from the spirit and scope of the present invention. It is therefore intended that the present invention not be limited to the exact forms and details described and illustrated, but fall within the scope of the present application.

What is claimed is:

1. A process for the preparation of glycine derivatives, comprising electrochemically oxidizing hydroxyl groups of β-hydroxyethylammonium compounds present in an aqueous solution to give corresponding acids.

2. The process as claimed in claim 1, wherein the electrochemical oxidation is carried out in the presence of electrodes that are coated with nickel oxide hydroxide.

3. The process as claimed in claim 2, wherein at least one of the electrodes comprises nickel metal, Monel, rust-free steel graphite or glassy carbon.

4. The process as claimed in claim 2, wherein at least one of the electrodes comprises nickel metal.

5. The process as claimed in claim 1, wherein the β-hydroxyethylammonium compounds are oxidized at a pH in the range from 8 to 14.

6. The process as claimed in claim 1, wherein the aqueous solution is an alkaline solution.

7. The process as claimed in claim 1, wherein said electrochemical oxidation is continuous or discontinuous.

8. The process as claimed in claim 1, wherein said β-hydroxyethylammonium compounds are present in said aqueous solution in a content of between 1 and 30% by weight.

9. The process as claimed in claim 1, wherein said electrochemical oxidation is carried out at a temperature of about 20° C. to about 80° C.

10. The process as claimed in claim 1, wherein said β-hydroxyethylammonium compounds comprise compounds of formulae (I), (II), (III) or mixtures thereof:

(I)

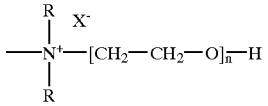

(II)

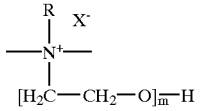

-continued
(III)
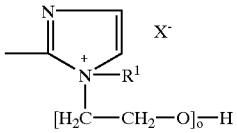
wherein
each R independently of one another is alkyl radicals having 1 to 3 carbon atoms, —$CH_2$—$CH_2$—OH or mixtures thereof;
n, m, o are values between 1 and 5; and
$R^1$ is an alkyl radical, or the radical $R^a$—[C(O)—NH—$(CH_2)_q]_r$— where q=1 to 6, and r=0 or 1 and $R^a$ is an alkyl or alkenyl radical having 1 to 2 carbon atoms.
* * * * *